US005207267A

United States Patent [19]

Iwamoto et al.

[11] Patent Number: 5,207,267

[45] Date of Patent: May 4, 1993

[54] INJECTION CONTROL METHOD OF DIE CAST MACHINE

[75] Inventors: Norihiro Iwamoto; Masayuki Takamura; Toshihiko Kaneko, all of Zama, Japan

[73] Assignee: Toshiba Kikai Kabushiki Kaisha, Tokyo, Japan

[21] Appl. No.: 743,253

[22] Filed: Aug. 9, 1991

[30] Foreign Application Priority Data

Aug. 9, 1990 [JP] Japan ..... 2-212606
Nov. 7, 1990 [JP] Japan ..... 2-301634

[51] Int. Cl.[5] ..... B22D 17/32

[52] U.S. Cl. ..... 164/457; 164/154; 164/155

[58] Field of Search ..... 164/457, 154, 155

[56] References Cited

U.S. PATENT DOCUMENTS

| | | | |
|---|---|---|---|
| 3,731,727 | 5/1973 | Mitamura et al. | 164/154 |
| 4,019,561 | 4/1977 | Aoki | 164/457 X |
| 4,660,620 | 4/1987 | Ozeki | 164/457 |
| 4,884,621 | 12/1989 | Ban et al. | 164/154 X |

FOREIGN PATENT DOCUMENTS

| | | | |
|---|---|---|---|
| 2021182 | 11/1971 | Fed. Rep. of Germany . | |
| 58-173068 | 10/1983 | Japan | 164/457 |
| 59-61560 | 4/1984 | Japan | 164/457 |
| 59-47626 | 11/1984 | Japan . | |
| 60-76267 | 4/1985 | Japan | 164/457 |
| 60-99472 | 6/1985 | Japan | 164/457 |
| 61-193763 | 8/1986 | Japan | 164/457 |
| 61-276760 | 12/1986 | Japan | 164/154 |

OTHER PUBLICATIONS

"The Twin Circuit Multiplier System", Article describing the German application 2,021,182.

Derwent World Patents Index, English Abstract of German application 2,021,182.

*Primary Examiner*—J. Reed Batten, Jr.

*Attorney, Agent, or Firm*—Cushman, Darby & Cushman

[57] ABSTRACT

A stroke-end position of an injection cylinder of the die cast machine is detected and a position of the injection cylinder for sending a boosting-signal is set. This position is a predetermined standard boost stroke distance from the stroke-end position. When the injection cylinder reaches the position for sending the boosting-signal in the casting cycle, an oil-pressure intensifier is advanced. In this method, before casting is performed, a value representing a stroke after slowing-down and a setting value of the plunger stopping position are determined and the start point for slowing-down is calculated by subtracting the value of the stroke after slowing down from the setting value.

12 Claims, 15 Drawing Sheets

INJECTION CONTROL METHOD OF DIE CAST MACHINE

BACKGROUND OF THE INVENTION

1. Field of the Invention

This invention relates to an injection control method for a die cast machine.

2. Description of Related Art

It is known that the quality of die cast products may be greatly influenced by the injection speed and the injection pressure when the molten metal is filled into a mold cavity.

In a conventional die cast machine, a two-stage type drive cylinder is employed to obtain satisfactory pressure before the molten metal solidifies.

In a typical die cast machine 90, as shown in FIG. 10, a molten metal 92 is fed into an injection sleeve 93 and is then injected into a mold cavity 91 by a plunger 94. A hydraulic fluid on the rear side of an injection cylinder 95 is pressurized by an oil-pressure intensifier 96 having a large diameter as the injection process is completed, so that the molten metal 92 in the mold cavity 91 is further pressurized.

An injection speed progression of the die cast machine 90 is shown in FIG. 11(B). The advance speed of the injection cylinder 95 is slow at first and increases rapidly after passing time $t_1$. Incidentally, the speed of the injection cylinder 95 decreases according to the pressure increase of the molten metal 92. At time $t_2$, the oil-pressure intensifier 96 is activated to further advance the injection cylinder 95 until time $t_3$ when the advancement thereof is terminated. The termination point of the advancement of the injection cylinder 95 is defined as a stroke-end position Dse.

In FIG. 11(A), an injection pressure progression of the die cast machine 90 is shown. A pressure curve L1 increases rapidly due to the advancement of the oil-pressure intensifier 96 after the time $t_2$ when the injection process is completed. Intensifier 96 ceases operation at $t_4$.

The link control of cylinders 95 and 96 in the die cast machine 90 is generally conducted by a sequential-valve control as shown in FIG. 12 or a limit-switch control as shown in FIG. 13.

FIG. 12 illustrates an oil-pressure circuit 114 having a check valve 111 and a speed-control valve 112 coupled between an accumulator 113 and the injection cylinder 95. FIG. 12 further illustrates an oil-pressure circuit 117 having a pilot-type intensify valve 116 and a sequential valve 115 coupled between the oil-pressure intensifier 96 and the accumulator 113. The sequential valve 115 is set to open the intensify valve 116 when the pressure in the oil-pressure circuit 114 of the injection cylinder 95 exceeds a predetermined boost-start point. As a result, the injection cylinder 95 is advanced as controlled by the speed-control valve 112 to inject the molten metal into the cavity. The sequential valve 115 is actuated after the injection process is completed to open the intensify valve 116 and the oil-pressure intensifier 96 is advanced to further pressurize (i.e. "boost") the molten metal injected in the mold cavity.

In FIG. 13, the injection cylinder 95 is shown as having a check valve 121 which penetrates the oil-pressure intensifier cylinder 96 along the center axis thereof and an accumulator 123 which includes a change valve 122 at the flow passage to the injection cylinder 95. The oil-pressure intensifier 96 is also shown as having an accumulator 126 provided with the change valve 125 controlled by a magnetic valve 124 which is connected to a limit switch 127. The limit switch 127 is disposed where it may contact projection 129 of rod 128 just before the injection process is completed. Accordingly, the injection cylinder 95 is further advanced as controlled by the change valve 122 and the oil-pressure intensifier 96 may be advanced as controlled by the limit switch 127 just before the injection process of the injection cylinder 95 is completed.

However, in the above die cast machine 90, to achieve the preferable pressure curve L1 shown in FIG. 11(A), it is necessary to perform link control of cylinders 95 and 96 with accuracy especially to set a time for the advancement of the oil-pressure intensifier 96.

For example, if the advancement of the oil-pressure intensifier 96 occurs too soon before completion of the injection of the molten metal by the injection cylinder 95, the desired boosting may not occur as indicated by pressure curve L2 as shown in FIG. 11(A). Also, if the advancement of the oil-pressure intensifier 96 is late, the pressure boost in the cavity 91 starts after the advancement of the injection cylinder 95 is completed, and thus the molten metal 92 in the cavity 91 has begun to cool and the desirable effect may not be obtained as shown by pressure curve L3 in FIG. 11(A). In addition, it is difficult to change the time of the advancement of the oil-pressure intensifier 96 effectively by the conventional link control method.

Under the sequential-valve control method of in FIG. 12, if a boost start pressure of the sequential valve 115 is set low, the sequential valve 115 may be incorrectly activated before the injection process by the injection cylinder 95 is completed. This may occur because a pressure peak appears when the injection speed changes from low to high, or an unintentional increase of injection pressure occurs due to resistance between the injection sleeve and the plunger. Alternatively, if the boost start pressure is set high, a time lag occurs because the advancement of the oil-pressure intensifier 96 may not began until after the completion of the injection process. Furthermore, since the injection pressure should be altered to correspond to different types of molding dies, it is necessary to correct the setting pressure of sequential valve 115 every time a different molding die is used.

Under the limit-switch control method shown of FIG. 13, the stop position of the plunger differs with regard to different kinds of molding dies, thus requiring that the setting position of the limit switch 127 be adjusted for each corresponding die. Also, even if a molding die is not changed, if the amount of molten metal 92 supplied to the injection sleeve 93 as shown in FIG. 10 varies, the thickness of the metal 92 ("biscuit") remaining in the injection sleeve 93 after the completion of the injection process may vary. Accordingly, the position detected by the limit switch 127 does not always represent a position just before the completion of the injection process by the injection cylinder 95, thus the boost start position may not be reliable. Also, when the divergence of the change valve 125 of the oil-pressure intensifier 96 is increased, the advancement of the oil-pressure intensifier 96 is increased so that the advance stroke thereof may be longer than a desired stroke length or may reach the stroke end position Dse too quickly, thus the boosting may not be correctly achieved.

During conventional injection by an injection plunger in an injection cylinder, the injection speed is variable in one casting cycle to attain a desirable injection. For example, with reference to FIG. 14(B), an injection speed VL between an injection start time $T_0$ and time $T_1$ is slow to prevent a wave of the molten metal in the injection sleeve. An injection speed VH between the time $T_1$ and time $T_2$ is more rapid to complete the injection of the molten metal into the cavity before solidification. As the injection process is competed as shown in FIG. 14(A), the injection pressure is increased by a pressure $P_2$, so that the molten metal in the cavity is quickly boosted and solidified. Also, the injection plunger is further advanced until time $T_3$.

When reviewing the injection pressure progression in the above injection mode, the pressure in a low-speed injection zone is low (PL) and in a high-speed injection zone is high (PH) as shown in FIG. 14(A). Accordingly, if the injection speed remains high until the injection completion time $T_2$, an impulsive surge pressure Ps may be caused by the reaction force of the molten metal completely filling up in the cavity, so that the molten metal may tend to emit from the parting line of the die and undesirable forming such as a flash may appear.

It is therefore recommended to slow down the injection speed around a certain time $T_4$ which is near to the end of the high-speed injection zone and to reach the low speed Vd at the completion of the injection process as shown by a dotted line in FIG. 14(B). Such a slow-down control may eliminate the surge pressure Ps at the completion of the injection process, so that the smooth boosting indicated by the dotted line in FIG. 14(A) may occur.

It is required for the described slow-down control to slow down the injection speed until the completion of the injection process at time $T_2$. However, it is difficult to accurately monitor the injection process in the cavity. It may be possible to detect the injection completion time $T_2$ based upon the steep rising of the injection pressure shown in FIG. 14(A), but it is difficult to detect a prior time, that is, the slowing-down start time $T_4$ before the injection completion time $T_2$.

Accordingly, since the injection condition in the cavity seems to correspond to the advanced position of the injection plunger or the injection cylinder, the following method is introduced, in which the slowing-down of injection speed is conducted based on detection of the mechanical position of the injection plunger or injection cylinder.

In FIG. 15, it is known that an injection cylinder 60 has a piston 61 therein. The piston 61 is connected to an injection plunger 74 at its rod 61A by a coupling 77. Hydraulic piping is provided on the rear side of the piston 61 coupled into the injection cylinder 60. The piping 63 constantly contains a hydraulic fluid from an oil source 64 or an accumulator 65. Hydraulic piping 66 is connected on the front side of the piston 61 of the injection cylinder 60. The piping 66 is further connected to an oil tank 67 through a change valve 70, or to hydraulic piping 68 which is connected to the piping 63.

The change valve 70 may couple the piping 66 with the oil tank 67 as a solenoid 71 is excited. Low-speed injection may be performed by reducing the flow rate in a control valve 72. If solenoid 73 is excited, the piping 66 and 68 are coupled together with piping 63 to thereby advance the piston 61 quickly to perform high-speed injection. When both solenoids 71 and 73 are not excited, the piping 66 is coupled to the tank 67 through the restrictor 76 and the following flow rate control valve 72 so that the discharge of the pressured oil contained on the front side of the injection cylinder 60 is restricted to thereby slow down from high-speed injection.

To execute the above shifting of the change valve 70, a projection 77*a* is provided at one end of a coupling 77 of the piston rod 61A of the injection cylinder 60. Also, two corresponding limit switches 78 and 79 are provided. The limit switch 78 is positioned to contact the projection 77*a* at the time $T_1$ to switch the change valve 70 to the high-speed injection mode. The limit switch 79 is positioned to contact the projection 77*a* at the time $T_4$ to switch the change valve 70 to the low-speed injection mode.

Under such an arrangement of the injection cylinder 60, the piston 61 is first retracted to its retract limit position and the change valve 70 is shifted to the low-speed injection mode. The change valve 70 is automatically changed over by the limit switch 78 in accordance with the advancement of the piston 61 to thereby start the high-speed injection mode. The following limit switch 79 switches the change valve 70 to conduct the slowing-down mode.

In any conventional die cast machine, the supply amount of the molten metal varies because the molten metal is poured into the injection sleeve by a ladle at the beginning of every casting cycle. Such variation influences the advance volume or injection process completion position of the injection plunger or injection cylinder for every casting cycle. However, using the above mechanical detection system, it is difficult to adjust the positions both of the projection and the limit switch 79 to correspond to the injection completion position that may vary with every casting cycle. Hence, the precise slowing-down start timing may not be obtained.

As discussed above, it is desirable to adjust for the fluctuation of the molten metal supply amount at every casting cycle when performing the link control of the two-stage type injection cylinder which consists of the injection cylinder and the oil-pressure intensifier, or when performing the slowing-down control of the injection cylinder.

SUMMARY OF THE INVENTION

An object of the invention is to provide a reliable injection control method for a die cast machine. In particular, a first object of the present invention is to provide an injection control method constantly capable of performing an accurate, reliable pressurized injection (hereinafter "boost").

The invention comprises the steps of detecting a stroke-end position of the injection cylinder occurring when an injection process of the molten metal is completed; determining a position at a predetermined distance backward from the stroke-end position of a predetermined standard boost stroke, the position corresponding to a position of the injection cylinder when a boosting signal is to be output; advancing the injection cylinder in the casting cycle to fill the mold cavity with the molten metal; and outputting the boosting-signal to advance an oil-pressure intensifier when the injection cylinder reaches the position when the boosting-signal is to be output.

The invention may further comprise the steps of: detecting an actual stroke-end position of the oil-pressure intensifier; and adjusting the position indicating when the boosting-signal is to be output to keep the real stroke of the oil-pressure intensifier constant. The above adjustment may be done by observing the stroke-end position "Das" of the oil-pressed intensifier multiple times, averaging the observed values to get the average value DaeM, comparing the value DaeM with the setting value DaE of the stroke-end position of the oil-pressure intensifier, the value DaE being obtained by adding or subtracting the tolerance $\beta$, and adding or subtracting the corrected value to/from the position indicating when the boosting-signal is to be output.

The standard boost stroke may be set corresponding to a die, an oil-pressure intensifier and a necessary boosting capability. The position for sending the boosting-signal may be determined by repeating the observation the stroke-end position of the injection cylinder multiple times, averaging the observed values, and subtracting the standard boost stroke value from the average value.

A second object of the present invention is to provide an injection control method for a die cast machine to conduct slowing-down control of the injection cylinder even though the molten metal supply amount fluctuates. This invention comprises the steps of: determining a stroke after slowing-down of the invention cylinder and a setting value of the plunger stopping position; calculating a position at which slowing-down of the injection cylinder begins by subtracting the stroke after slowing-down from the setting value of the plunger stopping position; outputting a slowing-down control command to restrict a divergence degree of an injection speed control valve for the injection plunger when a front end portion of the injection plunger reaches the position at which slowing-down begins; measuring an observation value of the plunger stopping position; and recalculating the position at which slowing-down of the injection cylinder begins for additional casting cycles.

DETAILED DESCRIPTION OF PREFERRED EMBODIMENTS

The following is the explanation of the first embodiment of the invention with reference to the figures.

Figure 1:
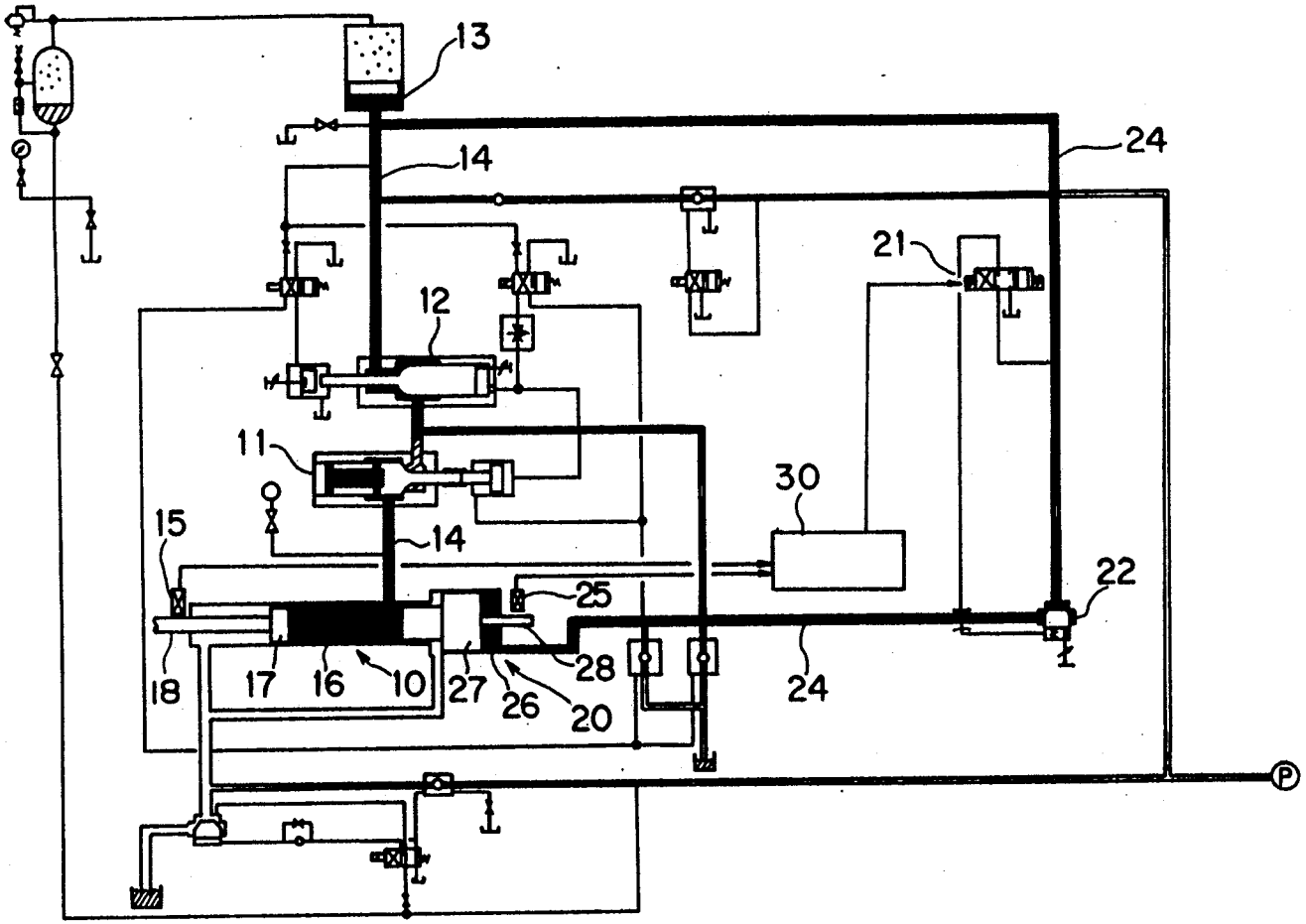
FIG. 1 illustrates a hydraulic circuit of the first embodiment in the invention.

As shown in FIG. 1, a die cast machine as in the first embodiment comprises an injection cylinder 10 and an oil-pressure intensifier 20. The injection cylinder 10 is connected to a hydraulic circuit 14 which extend to an accumulator 13 through a check valve 11 and a speed control valve 12. The oil-pressure intensifier 20 is connected to a hydraulic circuit 24 which extends to the accumulator 13 through a pilot-control type intensify valve 22 controllable by a magnetic valve 21. The magnetic valve 21 is coupled to a control system 30 to control the advancement of the oil-pressure intensifier 20. The control system 30 is coupled to an encoder 15 for detecting a stroke of the injection cylinder 10 and another encoder 25 for detecting a stroke of the oil-pressure intensifier 20.

Figure 2:
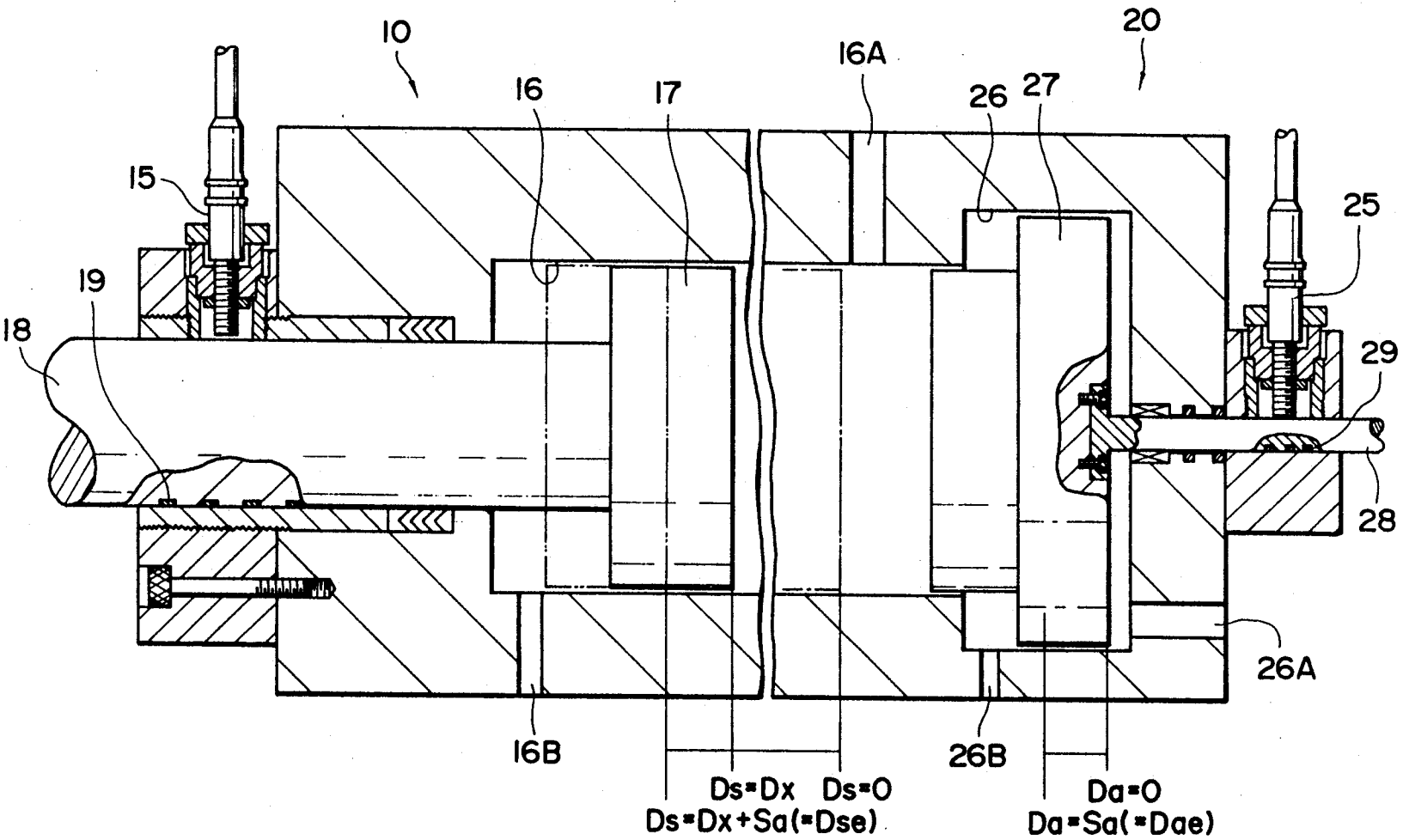
FIG. 2 is a sectional view of an essential portion of the first embodiment.

As shown in FIG. 2, the injection cylinder 10 comprises a sleeve 16 and a corresponding piston 17 which reciprocally advances and retracts due to a hydraulic fluid charged and discharged through ports 16A and 16B. The piston 17 is coupled to a rod 18 extending to an injection plunger (not shown). The rod 18 has, on the peripheral surface thereof, annular or spiral groove 19 and is non-magnetically galvanized and further grinned. The encoder 15 such as a magnetic pick-up is disposed at one end of the injection cylinder 10 and it front end is proximate to the rod 18, so that the encoder 15 may issue a pulse signal corresponding to the movement of the rod 18 to thereby detect an actual position Ds of the rod 18.

The oil-pressure intensifier 20 has, in its sleeve 26, a piston 27 which reciprocally advances and retreats due to a hydraulic fluid charged from each port 26A and 26B. The piston 27 has a larger diameter and thus has a larger drive force than that of the piston 17. The piston 27 also has a different diameter in order to boost the hydraulic fluid in the sleeve 16 to thereby push the piston 17 from its rear side. The piston 27 is coupled to a rod 28 which has, on the peripheral surface thereof, annular or spiral groove 29 and is non-magnetically galvanized and further grinned. The encoder 25 such as a magnetic pick-up is disposed at one end of the oil-pressure intensifier 20 and its front end is proximate to the rod 28 so that the encoder 25 may issue a pulse signal corresponding to the movement of the rod 28 to thereby detect an actual position Da of the rod 28.

Figure 4:
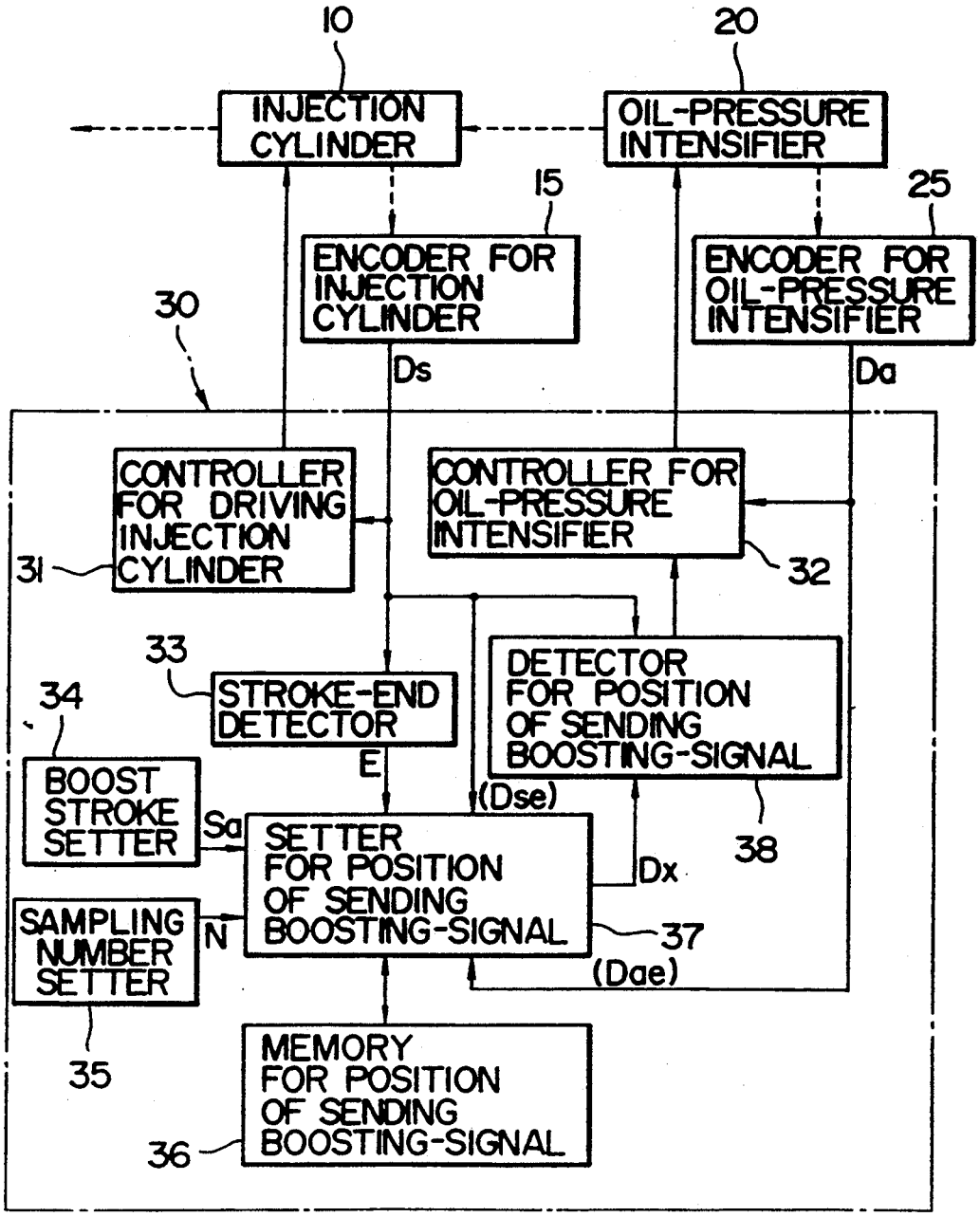
FIG. 4 is a block diagram showing a control system of the first embodiment.

As shown in FIG. 4, control system 30 comprises circuits for processing signals, a controller 32 for the oil-pressure intensifier 20, a stroke-end detector 33, a boost stroke setter 34, a sampling number setter 35, a memory 36 for storing a prior position of sending boosting-signal, a setter 37 for setting a position of sending boosting-signal and a detector 38 for detecting a position for sending a boosting-signal. The controller 31 controls the hydraulic circuit 14 to control the advance-and-retreat movement of the injection cylinder 10. Under the control, the actual position Ds from the encoder 15 for the injection cylinder 10 is referenced. Incidentally, a position Dse is the stroke-end position of the piston 17.

The controller 32 controls the hydraulic circuit 24 to control the advance-and-retreat movement of the oil-pressure intensifier 20. Under the control, the actual position Da from the encoder 25 for the oil-pressure intensifier 20 is referenced.

The stroke-end detector 33 is provided to detect the stroke-end position of the injection cylinder 10 and issue the stroke-end signal E. For example, if there is no change with referenced to the actual position Ds from the encoder 15, it is determined that the movement injection cylinder 10 is terminated.

The boost stroke setter is a memory to store the standard boost stroke Sa which is input by an operator. The sampling number setter 35 is a memory to store the number of times the sample data should be taken. This number is also set by the operator.

The memory 36 may correct a position Dx for sending boosting-signal with a prior position $Dx_o$ of sending boosting-signal which may be calculated by subtracting Sa from DseM. The DseM may be processed by the setter 37 and is an average value of the actual stroke-end position Dse divided by N.

Figure 3:
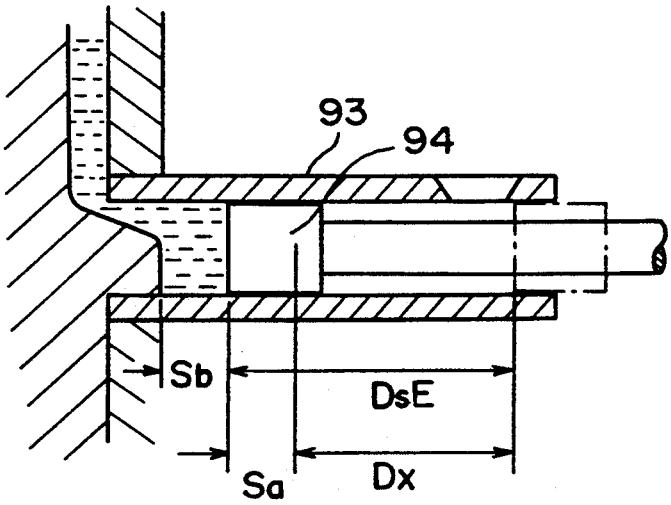
FIG. 3 is a sectional view of an essential portion of an injection cylinder.

In the setter 37, the actual positions Ds and Da are determined as the stroke-end positions Dse and Dae respectively when receiving a stroke-end signal E, so that a Dx is set as a position for sending a boosting-signal. Actually, as shown in FIG. 3, when the prior position Dx and the like are not set at the beginning of starting of the control system, the setting value DsE of stroke-end position of the injection cylinder 10 should be first determined with reference to the thickness Sb of the biscuit. The Dx may be calculated by subtracting the standard boost stroke Sa from the DsE. As shown by a flow chart in FIG. 5, the prior position $Dx_o$ for sending a boosting-signal is stored in the memory 36 and the stroke end position Dse is determined. The $Dx_o$ may be stored in the memory 36 by subtracting Sa from the Dse. Incidentally, if the sampling number N is equal to n, it is required to determine the average value DseM from the stroke nd positions Dse1, Dse2, . . . and $Dse_n$ and then the prior position $Dx_o$ for sending a boosting-signal is determined by subtracting Sa from DseM and is stored in the memory 36.

The detector 38 for position of sending boosting-signal monitors the actual position Ds from the encoder 15 and commands the controller 32 for oil-pressure intensifier 20 to advance when the actual position Ds of the injection cylinder 10 reaches the position Dx for sending a boosting-signal.

Figure 5:
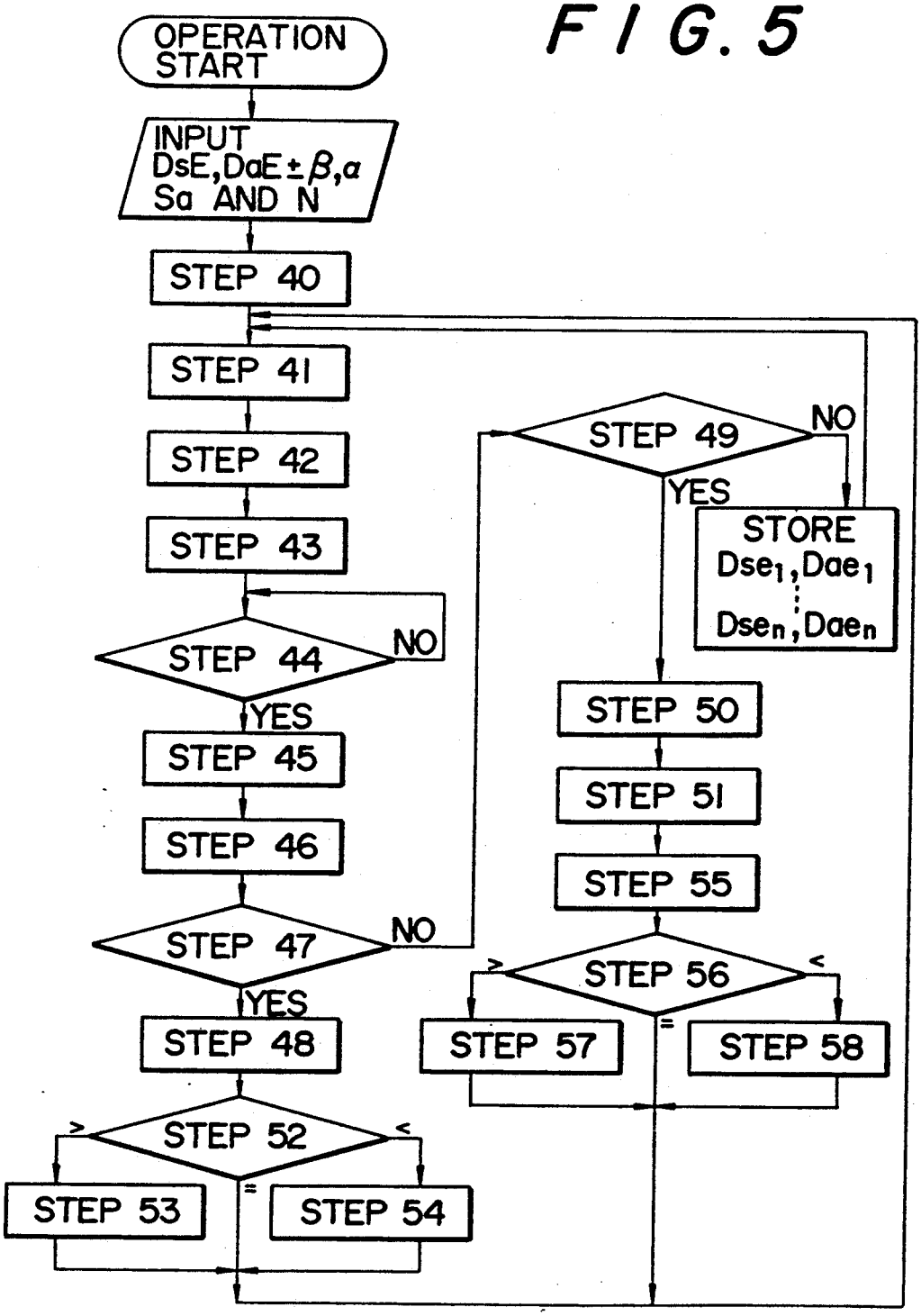
FIG. 5 is a flow diagram of the first embodiment.

A more detailed process is shown in FIG. 5. At the beginning of the injection cycle, as shown in FIG. 3, it is required to determine the setting value DsE of the stroke-end position by the biscuit thickness Sb, the standard boost stroke Sa, the sampling time N and others such as DaE, $\beta$, $\alpha$ each of which shall be explained. Dx is calculated by subtracting Sa from DsE (Step 40).

When both of cylinders 10 and 20 are retreated to the respective end positions by the controllers 31 and 32, the actual position Ds, Da of the encoder 15, 25 are set as zero, respectively (Step 41). In this condition, the molten metal is charged into the injection sleeve 93 (Step 42).

The injection cylinder 10 is advanced by the corresponding controller 31 (Step 43). When the advancement of the cylinder 10 reaches the position Dx for sending boosting-signal, the boost start signal is issued from the detector 38 (Step 44). Accordingly, the boosting may be conducted corresponding to the advancement of the oil-pressure intensifier 20 (Step 45).

When the boosting is completed, the stroke end position Dse of the single-action cylinder 10 is measured and stored (Step 46). If the number of sampling times N is 1 (Step 47), the boost start position D is determined by subtracting Sa from Dse by the setter 37, corrected with $Dx_o$ and then stored (Step 48). Otherwise, if the sampling times N is n (Step 49), the average value DseM is calculated from $Dse_1$, $Dse_2$, . . . and $Dse_n$ (Step 50). The $Dx_o$ is determined by subtracting Sa from DseM and Dx is corrected with $Dx_o$ and then stored (Step 51). Also, tolerance value $\gamma$ can be added to from DseM so that when the setting value DsE of stroke-end position is beyond the upper tolerance, $Dx_o$ is corrected. When all of these processes are completed, step 41 becomes the first step for a following injection cycle.

Another feature of the invention for maintaining the stroke end position Dae of the oil-pressure intensifier 20 shall be described hereafter. As explained above, before starting the injection cycle, each of the setting value of stroke-end position DsE, the standard boost stroke Sa, the sampling times N and the other data such as DaE, $\beta$ and $\alpha$ are input. DaE is the setting value of the stroke-end position of the oil-pressure intensifier 20 an has a tolerance$\pm\beta$. $\alpha$ is a corrected value of the position $Dx_o$ for sending boosting-signal. Experience has shown that the corrected value should be 5 to 10 mm.

If the number of sampling times N is 1 (Step 47), the stroke end position Dae of the oil-pressure intensifier 20 is compared to the setting value DaE$\pm\beta$ of stroke end position of the intensifier 20 (Step 52). If Dae exceeds DaE$+\beta$, the position $Dx_o$ for sending boosting-signal should be delayed by $\alpha$ (Step 53). Otherwise, if Dae exceeds DaE$-\beta$, the position $Dx_o$ for sending the boosting-signal should be expedited by $\alpha$ (Step 54).

If the number of sampling times N is n (Step 49), the stroke end positions $Dae_1$, $Dae_2$, . . . and $Dae_n$ of the oil-pressure intensifier 20 are measured and their average value DaeM is calculated (Step 55). The DaM is then compared to the setting value DaE$\pm\beta$ of stroke end position of the intensifier 20 (Step 56). If DaeM exceeds DaE$+\beta$, the position $Dx_o$ of sending boosting-signal should be delayed by $\alpha$ (Step 57). Otherwise, if DaeM exceeds DaE$-\beta$, the position $Dx_o$ of sending boosting-signal should be expedited by $\alpha$ (Step 58).

In the above mentioned embodiment, the following effects may be acquired. Since the advancement of the oil-pressure intensifier 20 is conducted when the injection cylinder 10 reaches the position Dx for sending boosting-signal, and since the position Dx is reset every injection cycle, the advancement timing of the oil-pressure intensifier 20 is always accurate. Hence, even though the stroke end position Dse of the injection cylinder 10 is changed corresponding to the supply amount of the molten metal, the position Dx of sending boosting-signal is automatically adjusted to thereby attain the preferable boost mode. Accordingly, the problems such as fault operation an rapid adjustment, due to variation in the conventional sequential-valve control and limit-switch control methods are eliminated.

Since the real stroke of the oil-pressure intensifier 20 is referenced when the position Dx for sending boosting-signal is set every cycle, the movement dispersion of the oil-pressure intensifier 20 due to the leakage of hydraulic fluid may be adjusted. The movement amount of the oil-pressure intensifier 20 may be maintained constant to correspond with the standard boost stroke Sa, so that the pressure under the boosting process is kept constant. Since the boost start position Dx is obtained by averaging the first to the N times values, the position shall not be sensitively varied by the sampling times N which may be set occasionally.

The embodiment of the invention shall not be limited as mentioned above, but, for example, the encoders 15 and 25 and the cylinders 10 and 20 can be changed.

The following is the explanation of the second embodiment of the invention with reference to the Figures.

Figure 6:
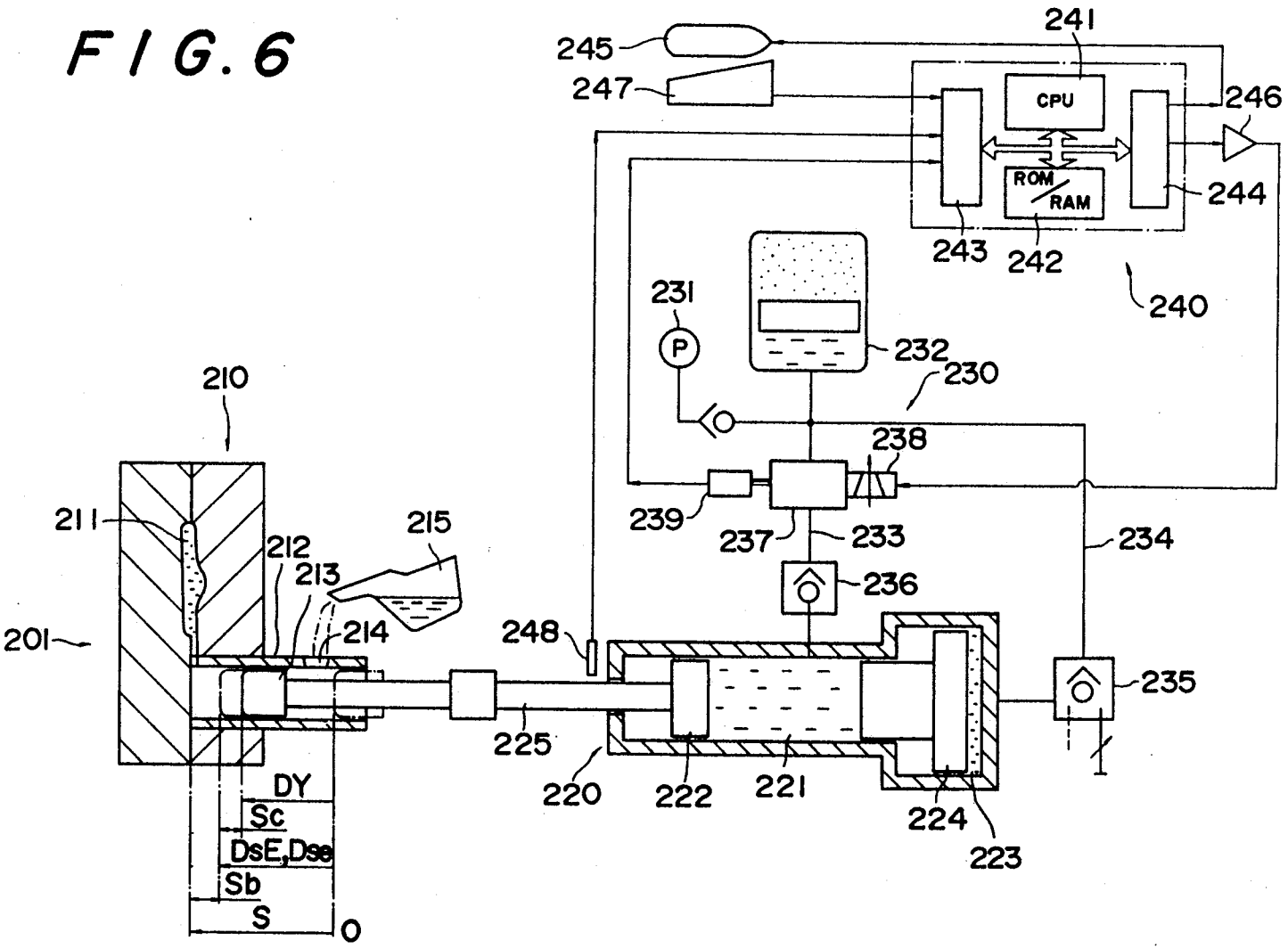
FIG. 6 is a schematic view of the second embodiment of the invention.

In FIG. 6, a cold-chamber type die cast machine 201 of the invention is shown. A die 210 has a molding cavity 211 therein and is connected to an injection sleeve 212. An injection plunger 213 is coupled to the injection sleeve 212. The plunger 213 advances and thus inject a molten metal charged from an opening 214 by a ladle 215 into the cavity 211. The movement of injection plunger 213 is performed by an injection cylinder 220 provided along the same axis as that of the plunger 213.

The injection cylinder 220 comprises two sized cylinders, one of which 221 has an injection piston 222 therein and the other 223 has an intensify piston 224 therein. The injection piston 222 is connected to the injection plunger 213 through the rod 225 and is advanced by a pressured oil charged into the injection cylinder 221. The intensify piston 224 is advanced by a pressured oil charged into the oil-pressure intensifier 223 to thereby conduct a boost mode with the injection piston 222 and the injection plunger 213 moved together via a hydraulic fluid filled in the injection cylinder 221.

The injection cylinder 220 is provided with an oil pressure circuit 230. The oil pressure circuit 230 has an oil source 231 such as a pump for pressurizing the hydraulic fluid and an accumulator 232 and further includes piping 233 for the injection cylinder 221 and piping 234 for the oil-pressure intensifier 223. The piping 234 includes a pilot-control type intensify valve 235 in the path to the oil-pressure intensifier 223 so that when the injection piston 222 reaches the filling completion position $T_2$, the intensify valve 235 is automatically altered by a sequential valve (not shown) to advance the intensify piston 224. The piping 233 includes a check valve 236 and a speed control valve 237 in the path to the injection cylinder 221 as to optionally control the advancement speed of the injection piston 222 corresponding to the divergence of the speed control valve 237. The speed control valve 237 is driven by the solenoid 238 and the like and the divergence thereof may be detected by an encoder 239.

The oil pressure circuit 230 is coupled to a control system 240 for controlling the movement of the injection cylinder 220. The control system 240 is a microcomputer or the like and comprises a CPU 241, a memory 242, an input circuit 243 and an output circuit 244. The output circuit 244 is further connected with a display 245 for providing various information to an operator and an amplifier 246 for the speed control valve 237 is connected to the solenoid valve 238. The input circuit 243 is connected to the solenoid valve 238. The input circuit 243 is connected to a keyboard 247, an encoder 239 for detecting the speed control valve 237 and a position sensor 246 for detecting the movement amount of the injection cylinder 220. The position sensor 248 is a magnetic pick-up or the like disposed close to the circumferential surface of the rod 225 on which surface is provided with a magnetic scale alternatively having a magnetic portion and a non-magnetic portion. When the rod 225 is moved, the position sensor 248 issues pulses corresponding to the number of magnetic bands to thereby indicate the movement amount with reference to the pulses.

Figure 7:
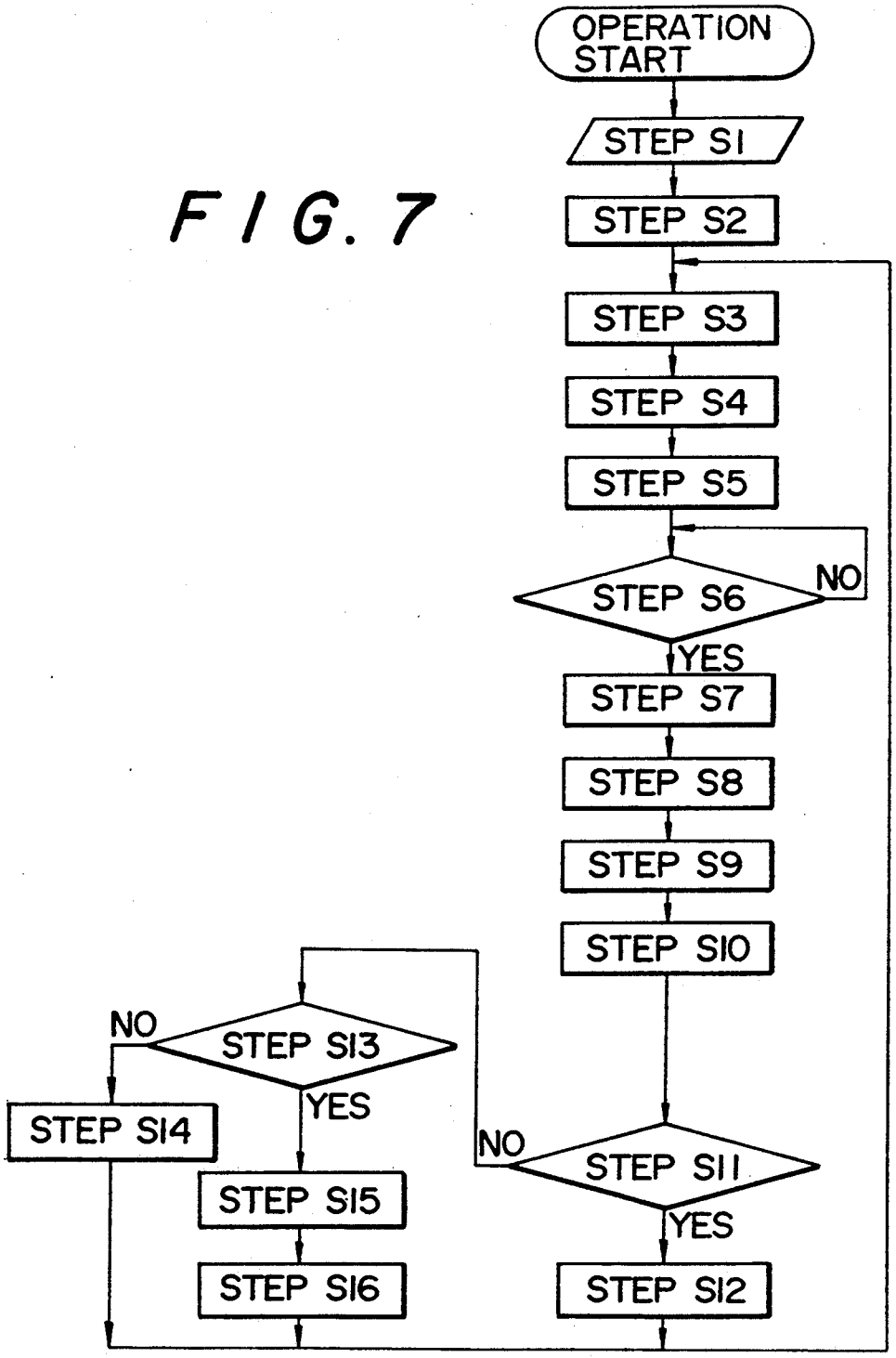
FIG. 7 is a flow chart showing a control process of the second embodiment.

The actual casting mode is performed as shown in FIG. 7. Before starting the casting, it is required to input from the keyboard 246 the value of a stroke Sc after slowing-down, a setting value of stroke-end position DsE of the plunger 213 and sampling times N. Each of these valve are stored in the memory 242 (Step S1). A start point of slowing-down DY is calculated by subtracting Sc from DsE in the CPU 241 and is stored in the memory 242 (Step S2).

As shown in FIG. 6, the setting value DsE of the plunger 213 stopping position may be calculated by subtracting a standard thickness Sb of the biscuit from a whole stroke S. Experience has shown that the stroke Sc after slowing-down may be determined based on an injection speed before slowing down an a capability of slowing down.

Figures 14A, 14B:
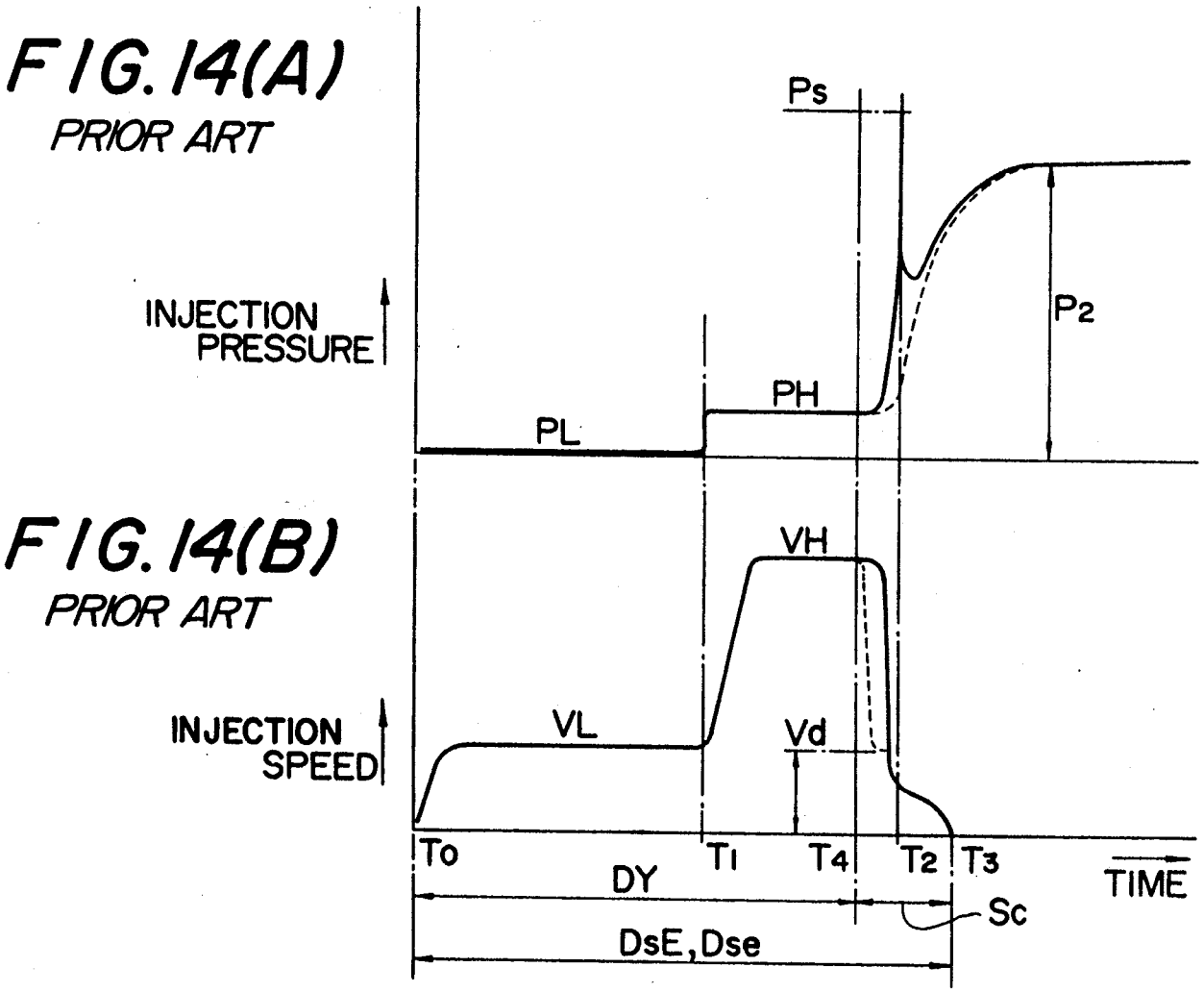
FIG. 14(A) PRIOR ART
FIG. 14(B) PRIOR ART
FIGS. 14(A) AND 14(B) are diagrammatic charts each showing an injection mode.
Figure 15:
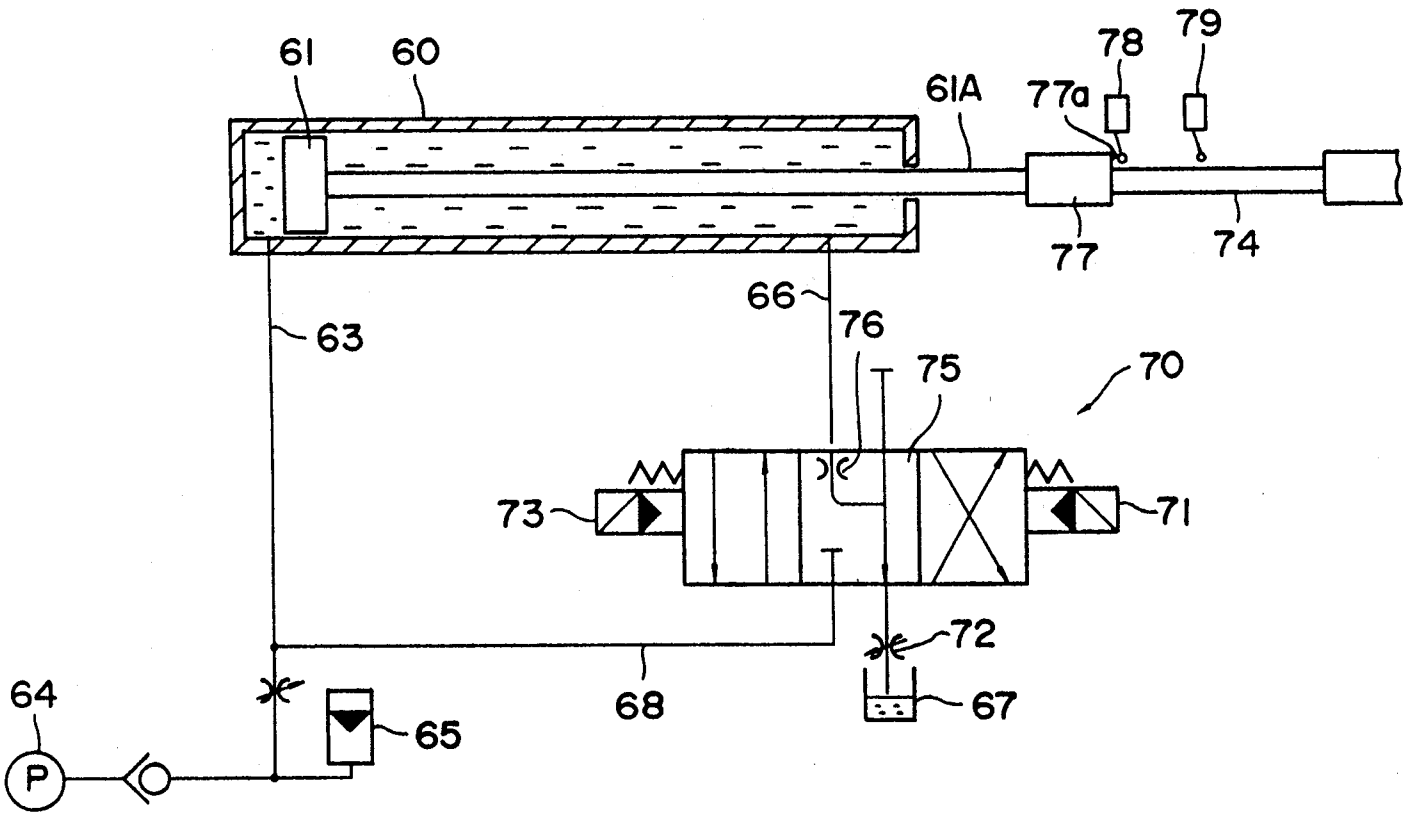
FIG. 15 PRIOR ART
FIG. 15 is a schematic view of another conventional machine.

The casting cycle is then started (Step S3). The molten metal is fed into the injection sleeve 212 (Step S4). The injection plunger 213 is advanced by the injection cylinder 220 activated by the oil pressure circuit 230 (Step S5) to thereby start injecting molten metal into the cavity 211. Incidentally, the injection speed is controlled to be slow at first and then to be fast later as shown in FIG. 14(B).

In the meantime, the control system 240 monitors the advancement of the injection plunger 213 by the position sensor 248 (Step S6). When the detected value reaches the start point of slowing-down DY, a slowing-down command is issued (Step S7). The divergence of speed control valve 237 is restricted by the solenoid 238 to make the plunger 213 slow down (Step S8). That is, the deceleration is controlled by the degree of divergence of the valve 237. Hence, the injection plunger 213 reaches the filling completion time $T_2$.

The control system 240 awaits the termination of the movement of plunger 213 (Step S9) The position of the injection plunger 213 is detected by the position sensor 248 and stored as the observation value Dse of the plunger stopping position (Step S10).

If the number of sampling times N is 1 (Step S11), a following start point $DY_o$ for slowing-down is calculated by subtracting Sc from Dse and the $DY_o$ value is stored as the new start point DY for slowing down (Step S12). One casting cycle is then completed. Additional casting cycles may be conducted by repeating Steps S3 to S12 with reference to the renewed start point DY for slowing-down.

If the number of sampling times N is less than 1 (Step S11), the casting cycle times n is checked to determine whether it reaches the sampling times N (Step S13). If the number of casting cycle times n does not reach the number of sampling times N but reaches a number of times i, respective observation values Dsel to Dsei of plunger stopping position are stored (Step S14).

When the number of casting cycle times n is equal to the number of sampling times N, an average value DseM is calculated from the observation values Dsel to Dsen of the plunger stopping positions (Step S15). The following start point of slowing-down $DY_o$ may be calculated by subtracting Sc from the DseM. The calculated $DY_o$ is stored as a new start point DY for slowing-down (Step S16). Hence, one casting cycle is completed, and a following casting cycle is performed by repeating Steps S3 to S12 with reference to the regenerated start point DY for slowing-down. Hence, the start points DY for slowing-down may be automatically adjusted for every casting cycle with reference to the stroke-end position Dse or DsE which is observed through the prior casting cycle.

Whenever the detected value Dse of plunger stopping positions is changed due to the fluctuation of the molten metal supply amount and the thermal deformation, the timing of slowing-down is automatically adjusted to thereby perform the preferable slowing-down control. When processing the start point DY for slowing-down after setting the sampling time N, the average value of N times detected value Dse is utilized, so that a sudden fluctuation that may occur while repeating casting cycles may be averted. Accordingly, the regenerated starting point for slowing-down may correspond to the continuous fluctuation and automatic control may be achieved by using the prior detected value Dse of a plunger stopping position. Also, since the speed control valve 237 is controlled when the injection speed is slowed down, the desirable deceleration may be obtained.

Figure 8:
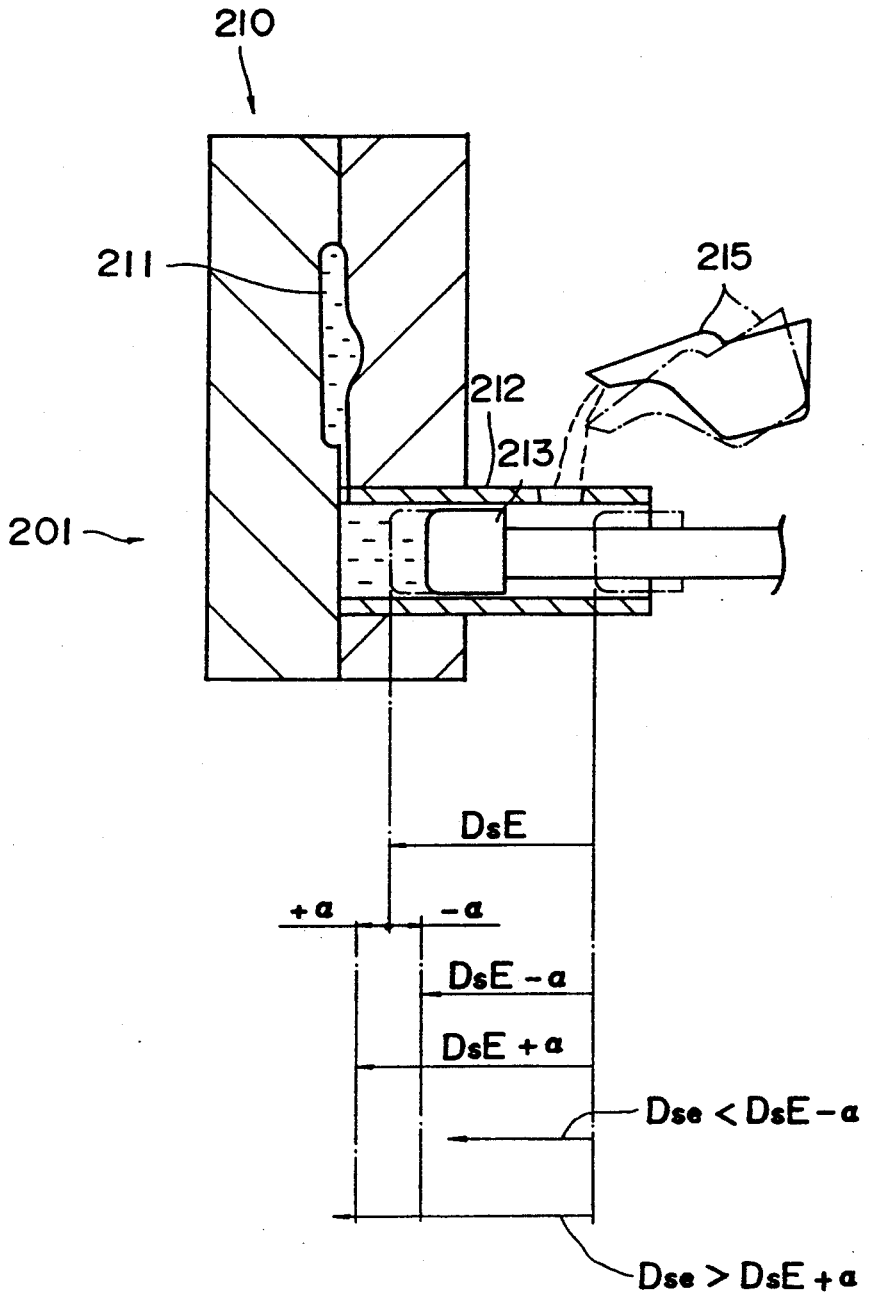
FIG. 8 is an essential view of the third embodiment of the invention.
Figure 9:
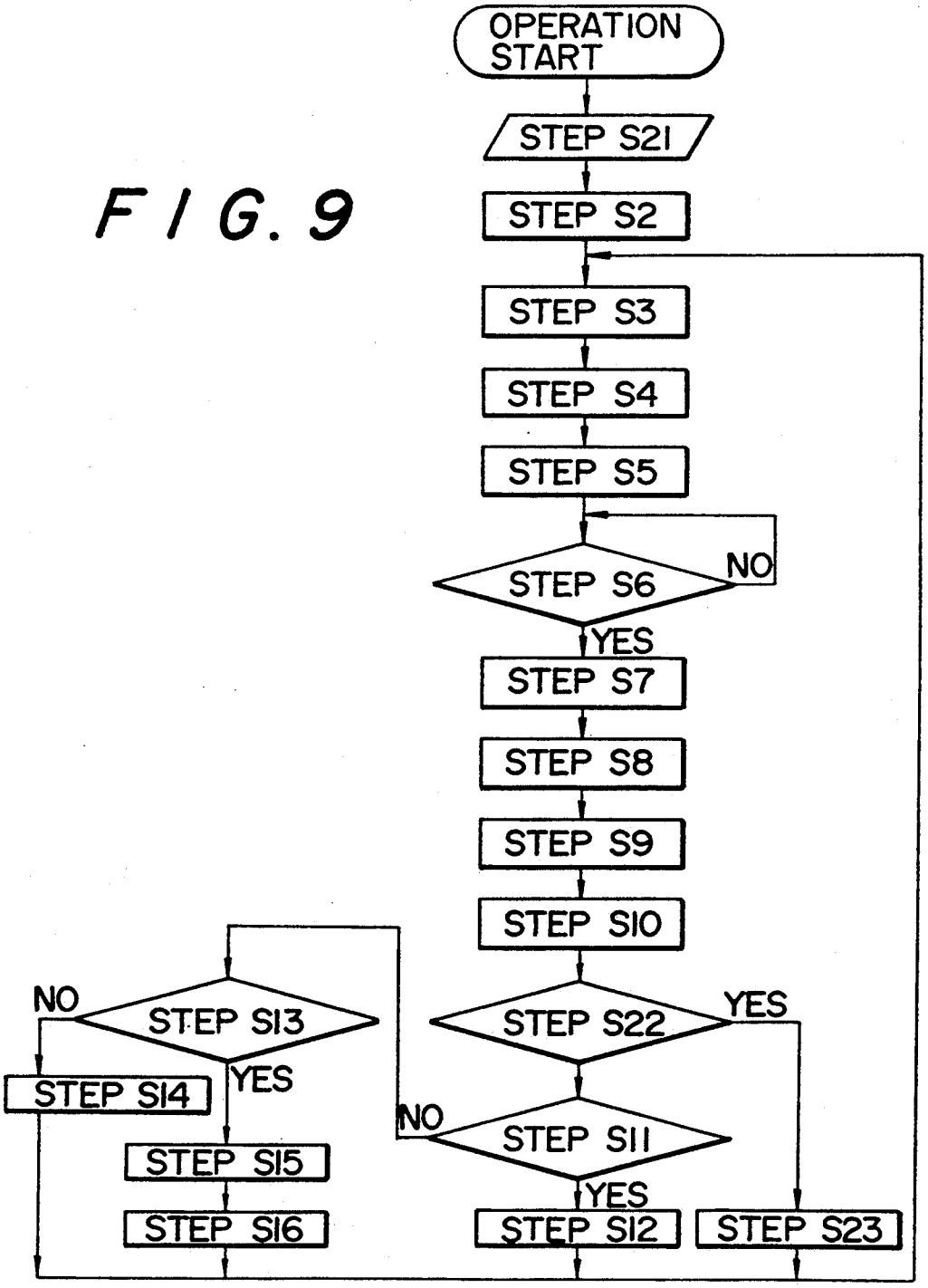
FIG. 9 is a flow chart showing a control process of the third embodiment.
Figure 10:
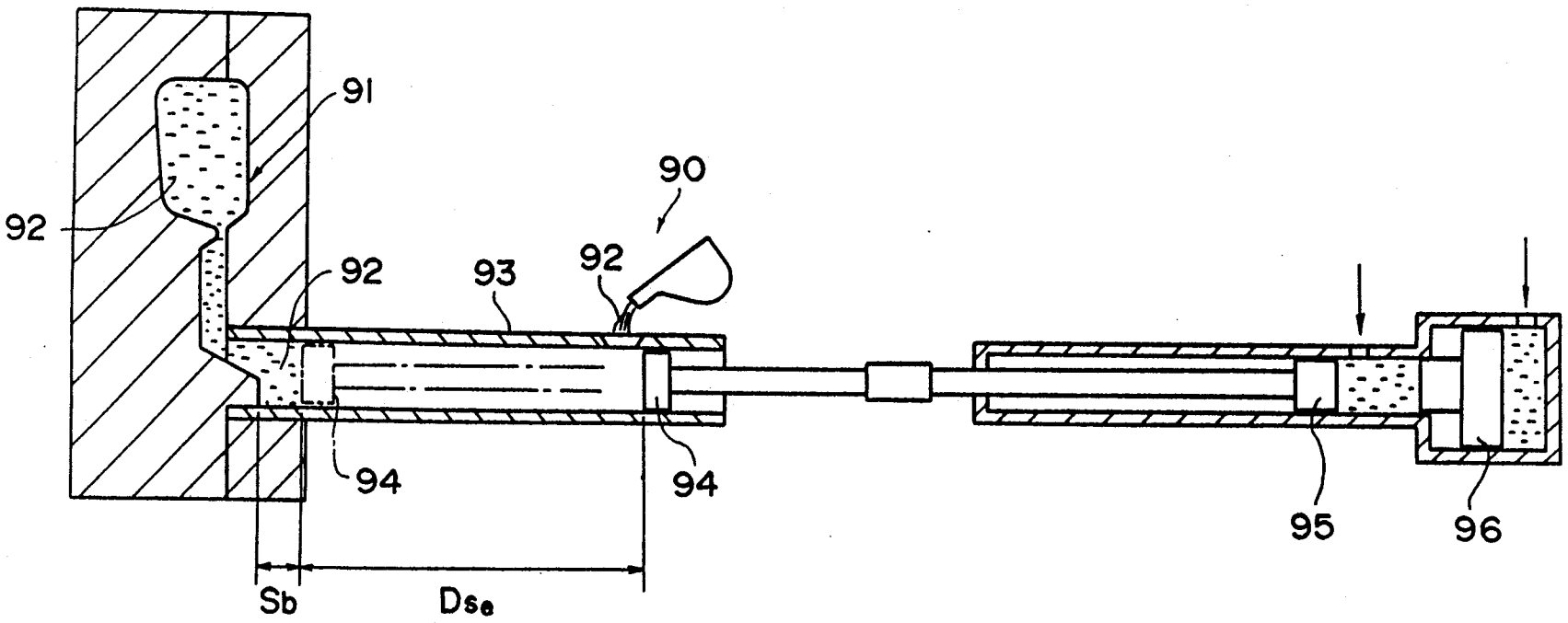
FIG. 10 PRIOR ART
FIG. 10 is a sectional view showing an essential construction of a conventional die cast machine.
Figures 11A, 11B:
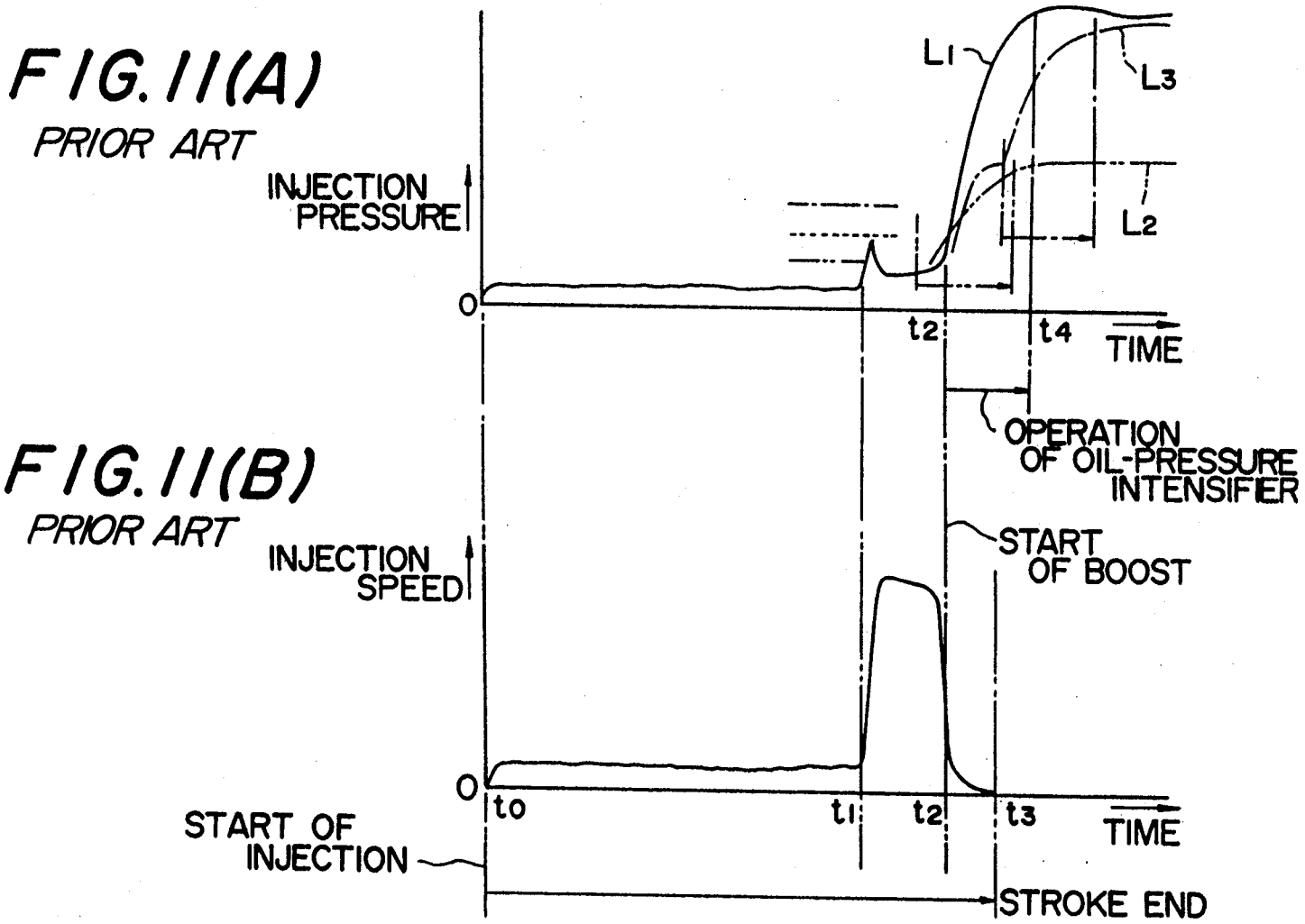
FIG. 11(A) PRIOR ART
FIG. 11(B) PRIOR ART
FIGS. 11(A) AND 11(B) are diagrammatic charts each showing a progression of an injection pressure and an injection speed in the conventional die cast machine.
Figure 12:
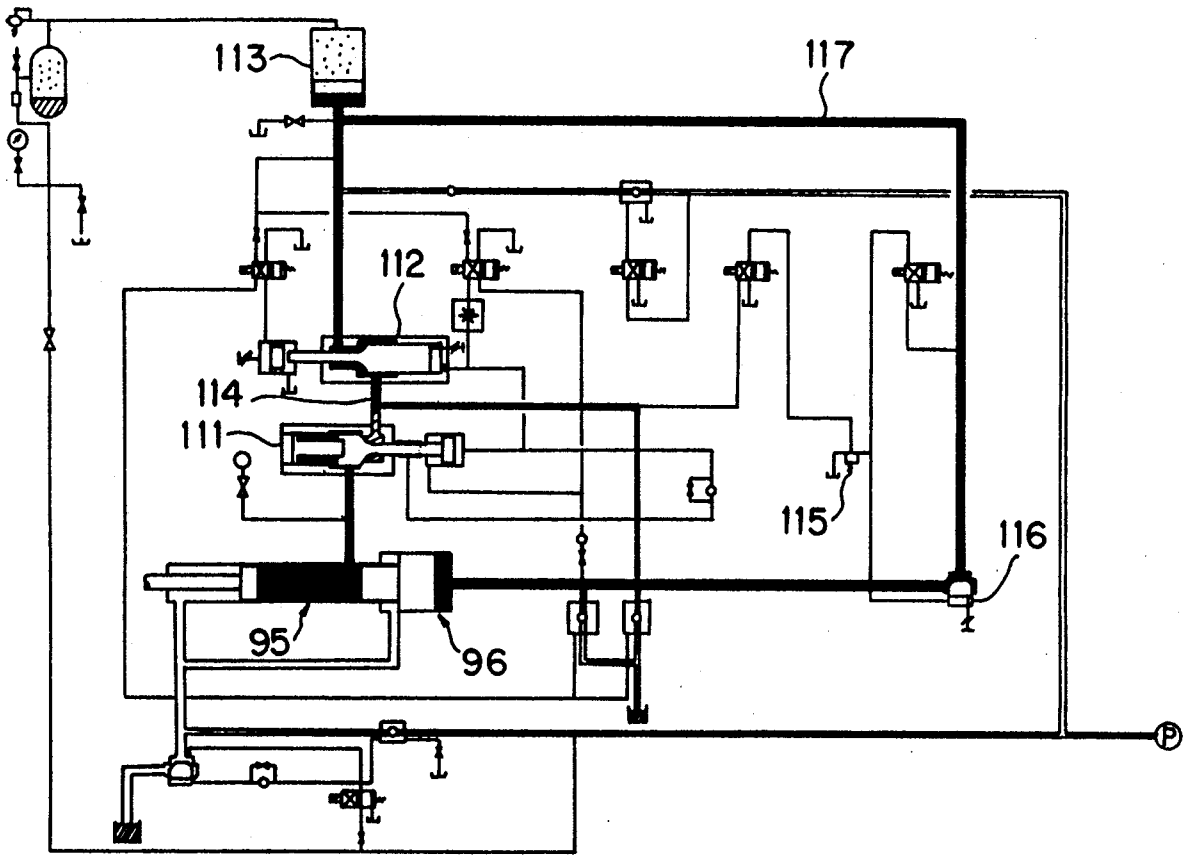
FIG. 12 PRIOR ART
FIGS. 12 and 13 are hydraulic circuits each showing a drive mechanism in the conventional die cast machine.
Figure 13:
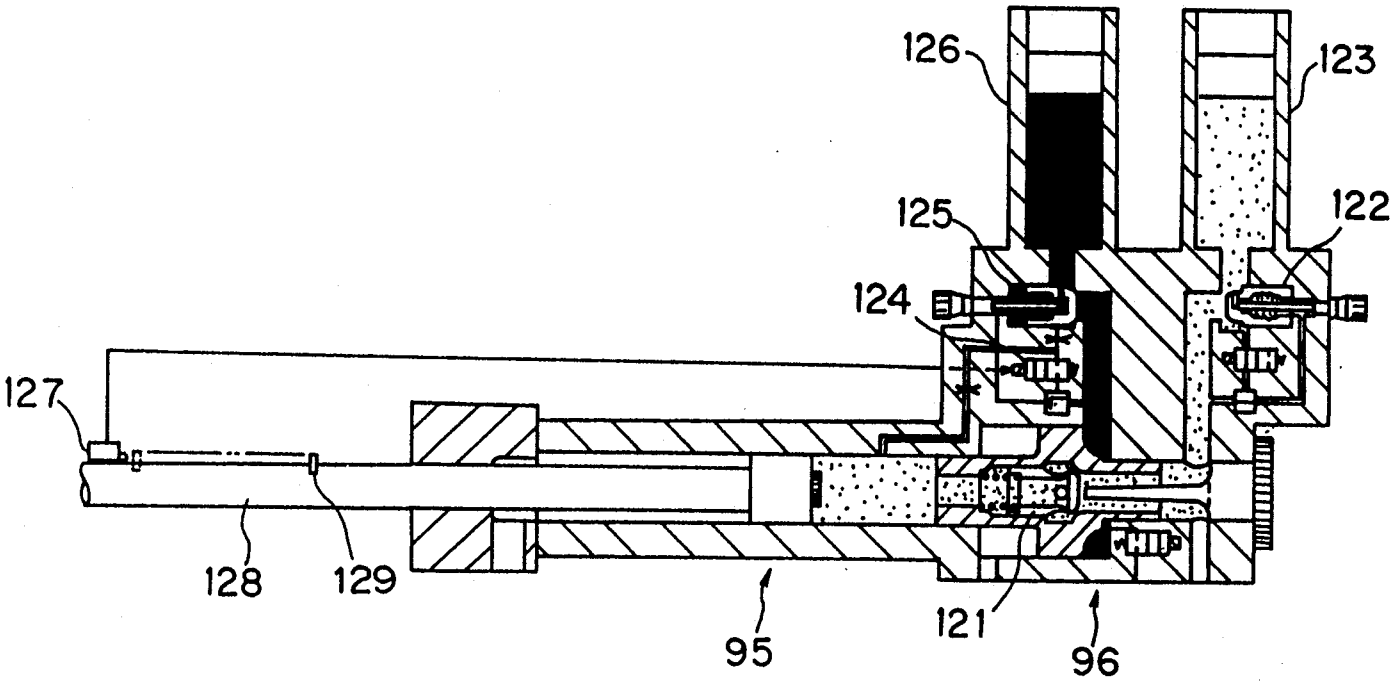
FIG. 13 PRIOR ART

In FIGS. 8 and 9, the third embodiment of the present invention is described. Through the second embodiment especially describes the slowing-down control, this third embodiment describes the compensation control of the molten metal supply amount.

The mechanical structure of the third embodiment is similar to the aforementioned embodiment shown in FIG. 6, so that the following descriptions are simplified. The fundamental control method for slowing-down is also similar, the same processes are denoted with the same numerals and the corresponding descriptions are simplified. Only the compensation control of molten metal supply amount is explained hereunder.

At the first setting before casting, the number of sampling times N, a stroke after slowing-down Sc, the inner diameter d of the injection sleeve 212, the setting value DsE of the plunger stopping position and the tolerance $\pm\alpha$ are input from the keyboard 247 and stored in the memory 242 (Step S21). The following steps S2 through S10 are the same as those in the aforementioned embodiment for perform the slowing-down control.

After the step S10, the measured observation value Dse of the plunger stopping position is examined (Step S22). If the examined fluctuation has a tolerance of $\pm\alpha$, the start point DY for slowing-down is not regenerated and the compensation for the molten metal supply amount is conducted (Step S23).

In the step S23, the CPU processes the molten metal supply amount fluctuation $\alpha' = \mathrm{Dse} - \mathrm{DsE}$ and molten metal supply weight $\pm\Delta W = (\frac{1}{4})\pi d^2\alpha'$ and then controls the supply amount to the injection sleeve 212 by $\pm\Delta W$. This command is sent to a control device of the ladle 215 in which the tilt angle of the ladle is adjusted to control the supply amount. Incidentally, using a magnetic pump instead, the supply amount control may be performed by a supply amount timer. When such compensation is performed, the casting cycle is completed. The following casting cycle may be executed by repeating the following steps from S3 using the same start point for slowing-down as that in the prior point DY.

While, in Step S22, if the fluctuation of the observation value Dse of the plunger stopping position is within the predetermined range, the starting point DY for slowing-down is regenerated by the same steps S11 through S16 as the mentioned embodiment. The following casting cycles may be done by repeating the following steps from S3 with reference to the regenerated starting point DY for slowing-down.

According to this embodiment, the showing-down control of the injection plunger is similar to the previous embodiment and the start time for slowing-down according to the fluctuation of the molten metal is automatically controlled. If the fluctuation of the observation value Dse of the plunger stopping position is not within $\pm\alpha$, the molten metal supply amount can be corrected, so that not only the starting point for slowing-down is changed but also the cause of the fluctuation may be compensated for.

In the third embodiment, the compensating control of molten metal supply is performed based on the determination of the observation value Dse of the plunger stopping position, but the control may be automatically performed by counting the number of casting cycles, that is, each cycle (e.g. the first, the fifth and the tenth cycle).

The present invention should not be restricted to the above mentioned embodiments and some of modifications may be allowed. For example, the structure of the die cast machine 1 may be changed. The arrangement of the die 210, the injection cylinder 220, the oil pressure circuit 230 and the control circuit 240 also can be changed. Also the controls employed in the first and the second embodiments or in the first and the third embodiments may be used at the same time.

What is claimed is:

1. An injection control method of a die cast machine for injecting a molten metal into a mold cavity by advancement of an injection cylinder and then boosting the molten metal by advancement of an oil-pressure intensifier comprising the steps of:

detecting a stroke-end position of the injection cylinder when injection of the molten metal into the mold cavity is completed;

determining a boost-start position at a distance equal to a predetermined standard boost stroke backward from the stroke-end position, the boost-start position identifying when a boosting-signal is to be provided;

advancing the injection cylinder to inject the molten metal into the mold cavity; and providing the boosting-signal to control the advancement of the oil-pressure intensifier when the stroke of the injection cylinder reaches the boost-start position.

2. The injection control method of the die cast machine according to claim 1, further comprising the steps of:

detecting an actual stroke-end position of the oil-pressure intensifier; and adjusting the boost-start position to maintain an actual stroke of the oil-pressure intensifier constant.

3. The injection control method of the die cast machine according to claim 2, wherein said step for detecting the actual stroke-end position of the oil-pressure intensifier is repeated multiple times to calculate an average value of the actual stroke-end position off the oil-pressure intensifier; and the adjusting step comprises the steps of:

comparing the average value with one of an upper limit calculated by adding a tolerance to a set value of the stroke-end position of the oil-pressure intensifier and a lower limit calculated by subtracting the tolerance from the set value;

adjusting the boost-start position by a predetermined corrected value to delay providing the boosting-signal when the average value is greater than the upper limit; and adjusting the boost-start position by a predetermined corrected value to expedite providing the boosting signal when the average value is less than the lower limit.

4. The injection control method of the die case machine according to claim 1, wherein the standard boost stroke is set in accordance with the mold cavity, the oil-pressure intensifier and a predetermined boosting capability.

5. The injection control method of the die cast machine according to claim 1, wherein the boost-start position is determined by repeating detection of the stroke-end position of the injection cylinder multiple times to obtain a plurality of detected values, averaging the detected values to calculate an average value, and subtracting the standard boost stroke value from the average value.

6. An injection control method of a die cast machine for injecting a molten metal into a mold cavity in accordance with advancement of an injection plunger and for slowing down the injection plunger just before completing injection of the molten meal into the mold cavity comprising the steps of:

determining a stroke of the injection plunger after slowing-down of the injection plunger and a set value of a stopping position of the injection plunger;

calculating a start point of the slowing-down of the injection plunger by subtracting a value representing the stroke after the slowing-down from the set value of the plunger stopping position;

providing a slowing-down control command to restrict a degree of divergence of an injection speed control valve for controlling movement of the injection plunger when a front end portion of the injection plunger reaches the start point of the slowing-down of the injection plunger;

measuring a detected value of the stopping position of the injection plunger;

recalculating the start point of the slowing-down by subtracting a value representing the stroke after slowing-down from the detected value of the plunger stopping position; and recalculating the start point of the slowing-down for a plurality of casting cycles.

7. The injection control method of the die cast machine according to claim 6, wherein a rate of the slowing-down of the injection plunger is variable.

8. The injection control method of the die cast machine according to claim 6, further comprising the steps of:

conducting predetermined molten metal compensation control when the measured detected value of the stopping position of the injection plunger is outside of a predetermined tolerance; and recalculating the start point for slowing-down based on the predetermined molten metal compensation control.

9. The injection control method of the die cast machine according to claim 6, further comprising the step of conducting predetermined molten metal compensation control during predetermined casting cycles.

10. The injection control method of the die cast machine according to claim 6, wherein the stroke after slowing-down is set in accordance with the mold cavity, the oil-pressure intensifier and a predetermined boosting capability.

11. The injection control method of the die cast machine according to claim 6, wherein the set value of the plunger stopping position is calculated by subtracting a value representing a thickness of a remaining portion of the molten metal solidified at the front end portion of the plunger after injecting the molten metal into the mold cavity from a value equal to a complete stroke of the injection plunger.

12. The injection control method of the die cast machine according to claim 6, further comprising the steps of:

determining the stopping position of the injecting plunger multiple times;

averaging the detected plunger stopping positions to obtain an average value; and calculated the start point of slowing-down by subtracting a value representing the stroke after slowing-down from the average value.

* * * * *